US010731286B2

(12) United States Patent
Sharkey et al.

(10) Patent No.: US 10,731,286 B2
(45) Date of Patent: Aug. 4, 2020

(54) ADAPTIVE FILL SYSTEM AND METHOD

(71) Applicant: Alliance Laundry Systems LLC, Ripon, WI (US)

(72) Inventors: Wayne M Sharkey, Ripon, WI (US); Jeffrey R Hochtritt, Neenah, WI (US); Benjamin R Patri, Hortonville, WI (US)

(73) Assignee: Alliance Laundry Systems LLC, Ripon, WI (US)

( * ) Notice: Subject to any disclaimer, the term of this patent is extended or adjusted under 35 U.S.C. 154(b) by 109 days.

(21) Appl. No.: 15/679,541

(22) Filed: Aug. 17, 2017

(65) Prior Publication Data

US 2019/0055690 A1 Feb. 21, 2019

(51) Int. Cl.

*D06F 33/00* (2020.01)
*D06F 39/08* (2006.01)
*D06F 37/38* (2006.01)

(52) U.S. Cl.

CPC ..... *D06F 39/087* (2013.01); *D06F 33/00* (2013.01); *D06F 37/38* (2013.01); *D06F 2202/065* (2013.01); *D06F 2202/085* (2013.01)

(58) Field of Classification Search

CPC ..... D06F 39/087; D06F 33/02; D06F 37/38; D06F 39/003; D06F 2202/085; D06F 2206/065; D06F 2204/086

USPC .. 68/12.04, 12.02, 12.05, 12.06, 12.16, 207, 68/12.19, 12.21; 8/159, 158, 137

See application file for complete search history.

(56) References Cited

U.S. PATENT DOCUMENTS 3,030,790 A 4/1962 Davenport et al.
3,478,373 A 11/1969 McBride et al.
3,497,884 A 3/1970 Tichy et al.
4,697,293 A 10/1987 Knoop
4,835,991 A 6/1989 Knoop et al.
5,165,260 A 11/1992 Geiger
5,293,760 A * 3/1994 Tani ..... D06F 34/18 68/12.02
5,396,413 A * 3/1995 Kaneko ..... D06F 33/00 700/1
5,669,095 A * 9/1997 Dausch ..... D06F 34/18 8/158
5,692,313 A * 12/1997 Ikeda ..... D06F 37/225 34/58
5,768,728 A 6/1998 Harwood et al.
6,038,724 A 3/2000 Chbat et al.
6,151,742 A * 11/2000 Dausch ..... D06F 39/087 68/12.02
7,905,122 B2 * 3/2011 Murray ..... D06F 37/203 68/12.02
7,930,787 B2 4/2011 La Belle et al.
7,950,086 B2 * 5/2011 Ashrafzadeh ..... D06F 23/00 8/158
8,214,954 B2 * 7/2012 Ashrafzadeh ..... D06F 23/00 8/158
8,627,687 B2 * 1/2014 Ashrafzadeh ..... D06F 23/00 68/12.02
9,145,634 B2 * 9/2015 Erickson ..... D06F 37/203

(Continued)

*Primary Examiner* — David G Cormier
*Assistant Examiner* — Thomas Bucci
(74) *Attorney, Agent, or Firm* — Leydig, Voit & Mayer, Ltd.

(57) ABSTRACT

A machine and method for washing fabric articles adaptively fills a wash basin with water based on a time period between rotation reversal of the wash basin and a load present in the wash basin.

8 Claims, 5 Drawing Sheets

(56) References Cited

U.S. PATENT DOCUMENTS

| | | | | |
|---|---|---|---|---|
| 9,267,226 | B2 * | 2/2016 | Suel, II | D06F 33/00 |
| 9,303,347 | B2 * | 4/2016 | Hull | D06F 21/00 |
| 2005/0204482 | A1 * | 9/2005 | Murray | D06F 33/00 8/158 |
| 2007/0039106 | A1 * | 2/2007 | Stansel | D06F 37/203 8/159 |
| 2008/0120790 | A1 | 5/2008 | Ashrafzadeh et al. | |
| 2010/0241276 | A1 * | 9/2010 | Zhang | D06F 37/203 700/279 |
| 2011/0016738 | A1 * | 1/2011 | Ashrafzadeh | D06F 35/006 34/108 |
| 2014/0096327 | A1 * | 4/2014 | Lee | D06F 37/304 8/137 |
| 2015/0101668 | A1 * | 4/2015 | Janke | D06F 39/087 137/1 |
| 2015/0113740 | A1 * | 4/2015 | Lee | D06F 33/00 8/137 |
| 2015/0121630 | A1 * | 5/2015 | Lee | D06F 34/18 8/137 |

* cited by examiner

ADAPTIVE FILL SYSTEM AND METHOD

FIELD OF THE DISCLOSURE

The present disclosure is applicable to machines for washing fabric articles and, more particularly, to top-loading machines.

BACKGROUND OF THE INVENTION

Known machines for washing fabric items, or washing machines, typically include one or more user-selectable parameters such as water level, which the user can select depending on the size of a load and also on the type of fabric that the articles to be washed are made. While there are certain efficiencies to be realized when allowing the user to select the level of water in the machine, the user's estimations may not always be accurate, which can result in inefficient washing cycles that use either too much or too little water for the type and size of load present in the machine.

Attempts have been made in the past to automate the water filling operation of the machine such that an appropriate amount of water is used. One example of a previously proposed method for automatically setting the water level in a machine can be found in U.S. Pat. No. 7,950,086 (the '086 patent), which is directed to an Adaptive Water Level Adjustment for an Automatic Washer. The '086 patent describes a system and method for determining the degree of engagement between a clothes mover and fabric items during a wash process as a basis for setting the liquid level in the washer. In the '086 patent, the degree of engagement is determined based on determining a running average of amplitude of ripples in the waveform of the current or speed of a motor operating the clothes mover. While the system described in the '086 patent may be partially effective in determining a water level, inaccuracies for certain loads or types of loads may skew the determined water level.

BRIEF SUMMARY OF THE DISCLOSURE

The present disclosure relates to a system and method for adaptively filling the wash basin of a clothes or fabrics washer and, more particularly, to a system and method for automatically filling the wash basin with water such that the relative slip between the walls, paddles and/or agitators within the wash basin and a load of fabric items placed in the basin for washing is at a predefined level.

In one aspect, therefore, the disclosure describes a machine for washing fabric articles. The machine includes a chassis, a wash basin rotatably mounted in the chassis, the wash basin being adapted to accommodate therein a load, the load comprising one or more fabric items suspended in water, a water inlet valve adapted to allow water from a supply to be added to the load, a motor associated with the chassis and operably connected with the wash basin, the motor drawing a current during operation to generate a torque tending to rotate the wash basin in a first or a second direction, and an electronic controller associated with the motor. The electronic controller is programmed and operates to command the motor to rotate in the second direction when the wash basin and the load are rotating in the first direction, monitor the current drawn by the motor to determine presence of a first peak in the current drawn by the motor after commanding the motor to rotate in the second direction, initiate a timer when the first peak is determined to be present, monitor the current drawn by the motor to determine presence of a second peak in the current drawn by the motor after determining presence of the first peak, terminate the timer when the second peak is determined to be present, the timer having a time period elapsed, correlate the time period elapsed to a wash-fill level, compare the wash-fill level to a desired wash-fill level, and operate the water inlet valve to add water to the wash basin when the wash-fill level is below the desired wash-fill level.

In another aspect, the disclosure describes a method for adaptively setting a water level in a washer for fabric items. The method includes rotating a wash basin containing a load, the load comprising one or more items to be washed and water, in a first direction, reversing a rotation of the wash basin from the first direction to a second direction, monitoring a torque applied to rotate the basin in the second direction for a first peak torque, monitoring the torque applied to rotating the basin in the second direction for a second peak torque, measuring a time between presence of the first peak torque and the second peak torque to determine a time period between peak torques, correlating the time period between peak torques with a wash-fill parameter, and adding water to the load when the wash-fill parameter is below a desired wash-fill parameter.

In yet another aspect, the disclosure describes a method for adaptively setting a desired water level in a washer for fabric items. The method includes applying a torque in a first direction to rotate a wash basin containing a load in the first direction, the load comprising one or more items to be washed and water, reversing a direction of application of the torque from the first direction to a second direction, and monitoring a waveform indicative of a current drawn by an electric motor applying the torque using an electronic controller to determine: a first time instant at which the wash basin begins rotating in the second direction and a second time instant at which the load begins rotating in the second direction. The method further includes measuring a time elapsed between the first time instant and the second time instant, correlating the time elapsed with a slip parameter and adding water to the load when the slip parameter is below a desired slip parameter.

BRIEF DESCRIPTION OF THE SEVERAL VIEWS OF THE DRAWING(S)

DETAILED DESCRIPTION OF THE INVENTION

The present disclosure is applicable to machines for washing clothes and other fabric articles. Such machines typically carry out more than one operation in succession in a washing cycle including, for example, a pre-soak operation, a washing operation and one or more rinsing operations. Each cycle requires the machine to fill a wash basin, into which the fabric items are placed, with water. It has been determined that an appropriate amount of water should be added for a particular load of fabric articles for an efficient wash. The amount of water that is appropriate for a particular load depends on more than one factor such as the weight of the load, the composition of articles in the load, the absorptiveness of the type or types of fabric that make up the load, and the like. In the past, automated methods of determining an appropriate water fill had been proposed, which based water fill on the weight or inertia of the load and/or the combined weight or inertia of the load of fabric items and water. However, these methods are inaccurate because they do not account for the type of fabric in the load, the total absorptiveness of the load, and other parameters.

In the present disclosure, a method and system are described for adaptively filling a wash basing with an appropriate amount of water regardless of the weight or inertia of the load alone. The adaptive filling process includes monitoring a current draw of the motor operating to rotate the wash basin, and performing a reversal in rotation direction of the wash basing to determine a time period between reversal of rotation of the wash basin and a subsequent reversal of rotation direction of the load present in the wash basin to follow rotation of the wash basin. This time period, which is indicative of a relative slip between the wash basin and the load present in the basin, is correlated to a water fill sufficiency of the wash load. When the water fill sufficiency is determined to be low, water is incrementally added to the wash basin and the slip determination process including the rotation reversal is repeated until the water fill sufficiency, or slip, is determined to be at or above a desired threshold.

Figure 1:
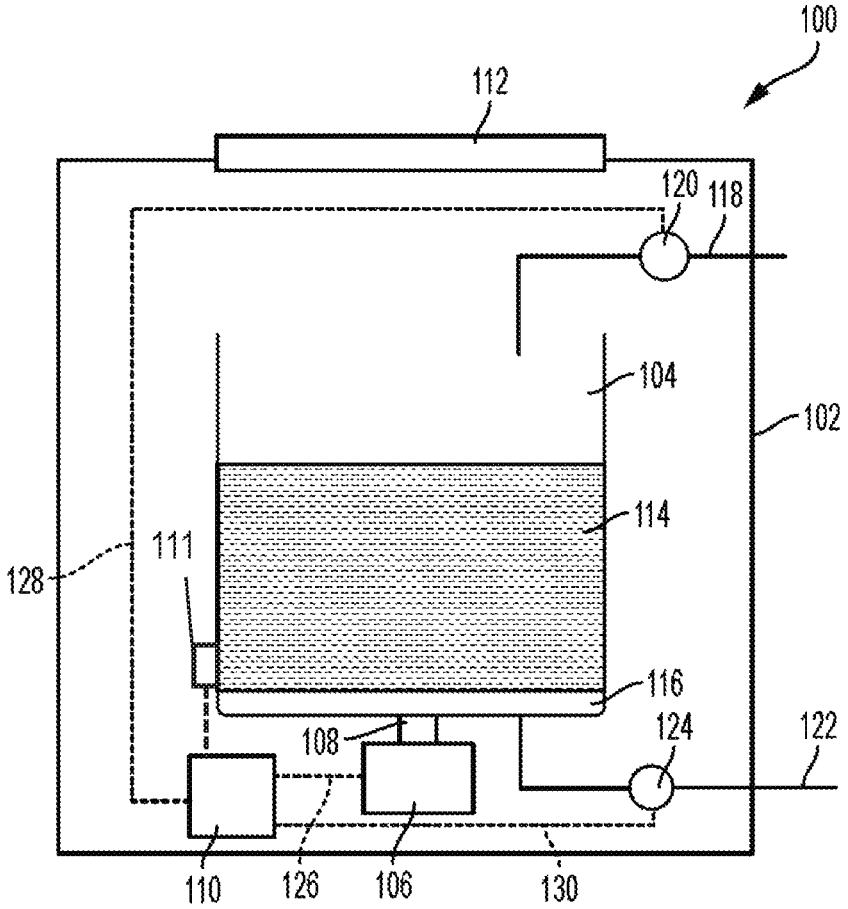
FIG. 1 is a schematic representation of a washer in accordance with the disclosure.

A machine 100 is shown schematically in FIG. 1 to illustrate various components that are relevant to the present disclosure, but it should be appreciated that the disclosed systems and methods have broad applicability to various other machine types that may be different than the machine 100 shown in FIG. 1. As shown in FIG. 1, the machine 100 includes a chassis 102 that encloses a wash basin 104. The wash basin 104 is rotatably supported in the chassis 102 and is associated with an electric motor 106 through a transmission 108. The electric motor 106 is mounted on the chassis 102 and, during operation, receives power and command signals indicating the direction and torque that is applied to rotate the wash basin 104 from a controller 110. The transmission 108 is optional and may be omitted.

The controller 110, which may be a standalone controller or a controller that cooperates with other controllers to control operation of various functions of the machine 100, is a programmable logic controller capable of executing computer executable instructions. The wash basin 104, which in the illustrated embodiment is open on the top, is accessible through a door 112 of the chassis 102 and is arranged for a top-loading configuration, meaning, fabric items are inserted in the basin and removed from the basin after being washed from the top of the machine 100. It should be appreciated, however, that the systems and method described herein are also applicable for front-loading machine configurations.

In the embodiment shown in FIG. 1, the wash basin 104 is loaded with a load of laundry 114, which is agitated during machine operation by an agitator arrangement 116 connected to the wash basin 104. In alternative embodiments, a separate agitator (not shown) that is independently operated, for example, by the electric motor 106, another electric motor (not shown), and/or the transmission 108, can be used. For adding water to the wash basin 104, a water inlet 118 is connected to a supply of water (not shown) and includes a control valve 120 that meters the water added to the wash basin 104 and is responsive to command signals from the controller 110. In a known fashion, more than one water supply can be used, for example, for supplying hot and cold water to the wash basin. Similarly, water is drained from the wash basin 104 through a water drain 122 that includes a flow control 124 that is responsive to control signals from the controller 110. The flow control 124 may include a valve to meter or control the flow of water drained from the wash basin 104, and may further include a pump or other actuator operating to draw water from the wash basin.

Figure 2:
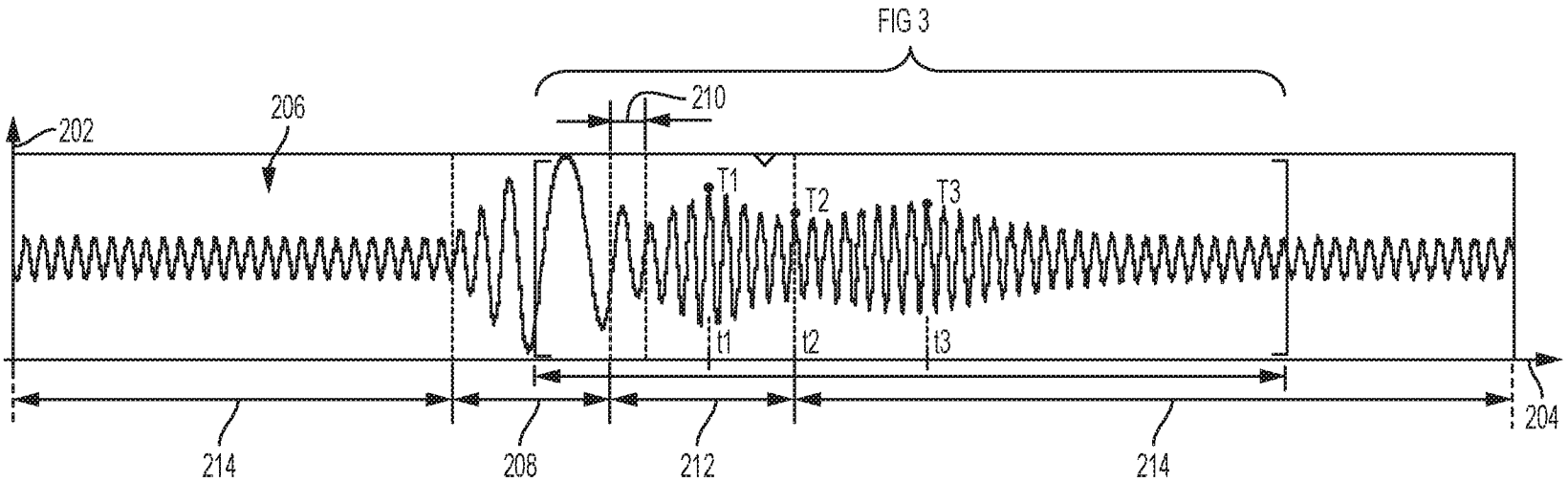
FIG. 2 is a graphical representation of a time trace of a current drawn by a motor operating the washer of FIG. 1.

The controller 110 communicates with various systems and actuators during operation of the machine 100 to receive and process information indicative of machine operating parameters and to also send command signals to the various actuators that carry out operations of the machine. For example, the controller 110 communicates with the motor 106 and/or the transmission 108 through a drive control line 126. Relevant to the discussion that follows, the controller 110 is configured to receive a signal through the drive control line 126 that is indicative of a current draw of the motor 106. The motor current signal will have a waveform shape as shown in FIG. 2, the amplitude of which indicates the current draw of the motor with respect to time. The controller 110 further communicates with the water inlet valve 120 through a water inlet communication line 128 and also with the water drain flow control 124 through a water drain communication line 130. By receiving information from the motor alone, the controller 110 is advantageously adapted to perform the adaptive fill operation, as described below. Optionally, the controller 110 may further receive a water level signal provided by a pressure sensor 111, which is associated with the wash basin 104 and disposed to measure a hydraulic water column pressure of water present in the wash basin 104. The controller 110 may automatically instruct a filling of the wash basin when additional water is required, and to also limit the water added to the basin based on the water level signal from the pressure sensor 111, for example, to avoid an overfilling of the basin.

Figure 3:
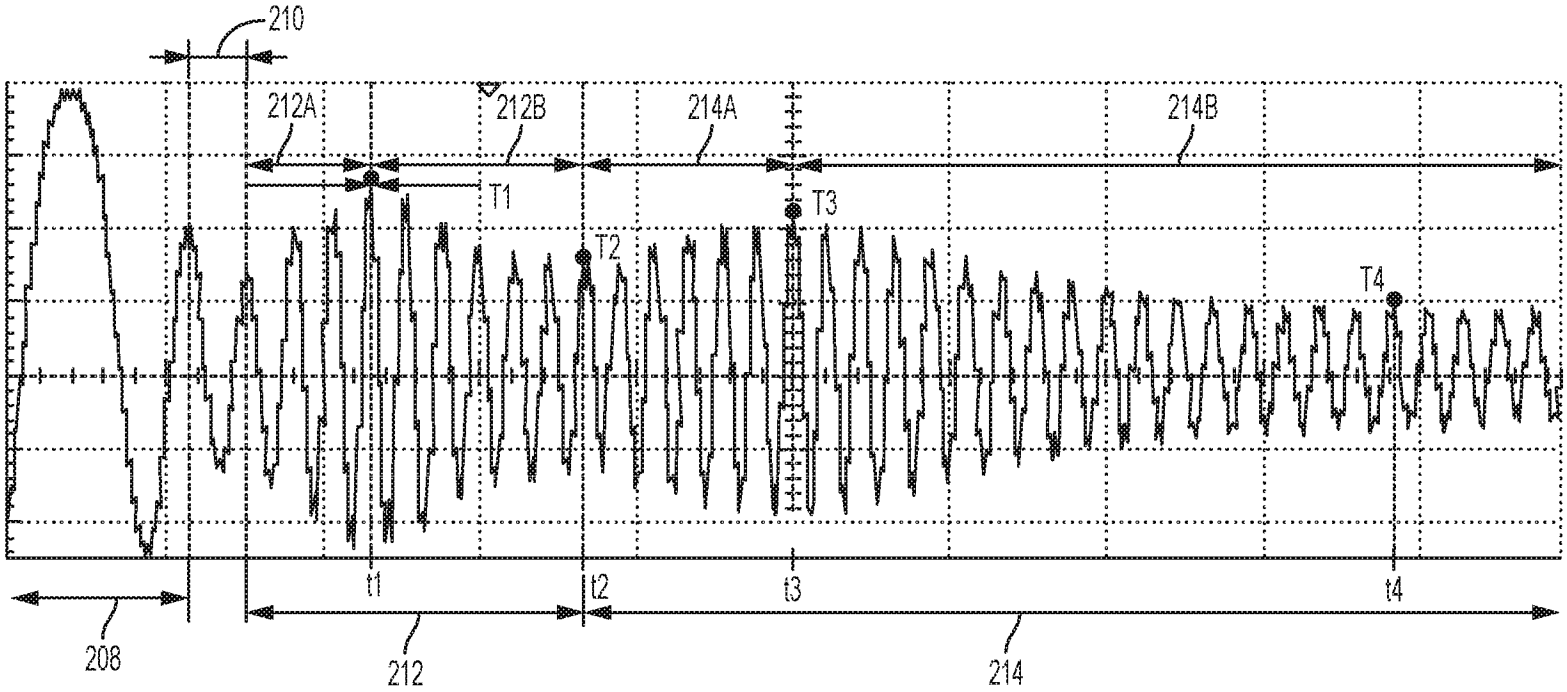
FIG. 3 is an enlarged detail of the time trace of FIG. 2.

Turning now to FIG. 2, motor current is represented along the vertical axis 202 and time is represented along the horizontal axis 204. A time trace 206, which is represented by a generally sinusoidal curve having a variable amplitude and, at times such as during a direction reversal, a variable period, is plotted against the axes 202 and 204 for a discrete period of machine operation that includes a reversal of rotation direction of the motor 106 and the wash basin 104 of a machine as shown, for example, in FIG. 1. An enlarged detail of the time trace 206 is shown in FIG. 3. In reference to these figures, at a time period 208 a command effecting a reversal of rotation of the motor is provided to the motor by the controller, for example, the controller 110 (FIG. 1). Before command issuance, the motor and wash basin may have been rotating in a first direction, for example, in a clockwise direction as viewed from the top. For reversing rotation, a direction of application of torque by the motor or transmission 106 or 108 onto the wash basin 104 may be reversed. Following torque reversal, the wash basin 104 may decelerate in terms of its angular velocity in the clockwise direction, momentarily stop, and then begin accelerating in a second, opposite direction, e.g., a counterclockwise direction. In one embodiment, instead of a reversal, the wash basin may be stationary and upon application of torque begin rotating in the direction of torque application by the motor or transmission.

In reference to FIGS. 2 and 3, the reversal period 208 indicates a change in amplitude and period of the trace 206 as the motor reverses the torque application direction and is resisted by the already rotating inertia of the wash basin and load. To ensure that measurements are not taken within the motor reversal period 208, which is not load dependent, measurements are not taken until after approximately 200 milliseconds, or another appropriate period, which is shown as a wait period 210 in FIGS. 2 and 3. A motor deceleration and acceleration into the new rotation direction follows during a motor acceleration period 212, which is illustrated in FIGS. 2 and 3. As can be seen, the amplitude of the trace over the motor acceleration period 212 increases to a first maximum, T1, at a time, t1, and then begins to decrease.

During the motor acceleration period 212, the increasing amplitude of motor current towards T1 occurs during period 212A in which the motor is accelerating in the new direction of rotation while the load is still rotating in the opposite direction. The maximum current/torque T1 occurs at instant t1 when the load breaks free from the agitator (or begins to slip past the agitator) or the wash basin and continues to slip in the opposite direction while decelerating. This load slip allows the motor and agitator to accelerate with decreasing current requirements to a target wash speed, as illustrated in period 212B.

At an instant t2, the torque is reduced to a local minimum value T2. The reduction in the torque applied by the motor from T1 to T2 represents the inertial rotation of the wash basin as it accelerates in the new direction of rotation while the combined water and load are decelerating. In the period between t1 and t2, the torque is decreasing as the wash basin accelerates in the new rotation direction, but the physical interference between the wash basin and the load is also increasing as the angular velocity of the wash basin increases. At the instant t2, the torque that is required to accelerate the load is less than the torque required to overcome the physical interference between the wash basin and the load. After t2, the torque begins to increase as the process transitions into a third period 214 (consisting of sub-periods 214A and 214B).

In the third period 214, the torque begins increasing from the local minimum value T2 towards a second maximum or peak torque T3 that occurs at a time instant t3. At the instant t3, deceleration of the load has ended and the load is stationary with respect to the chassis, i.e., the relative angular speed between the wash basin and the load contained therein is equal to the wash basin rotational speed, but in the opposite direction. Beyond the instant t3, the load begins rotating in the same direction as the wash basin, i.e., the new rotation direction and accelerates to match the angular speed of the basin at a fourth time instant, t4, which occurs at a second local minimum torque T4. As can be appreciated, the instant t4 shown in FIG. 3 is an approximation as the relative speed between the wash basin and the load approximates zero as it follows an exponential decay. At the instant t3, the torque T3 is maximum as the inertia of the load is added to the inertia of the wash basin when the wash basin and also the load are now rotating in the same direction.

The electronic controller that operates the machine is configured to monitor motor current, which is indicative of motor torque, and is particularly configured to discern and catalog or store at least the time instants t1 and t3. As it can be appreciated, the instant t2 can also be discerned and cataloged to facilitate sensing and determination of appearance of the time instant t3. The period between time instants t1 and t3 represents the period in which the wash basin and the combined water with fabric items present in the wash basin, or the load, are rotating in different directions following a rotation reversal of the wash basin. The controller is also configured to initiate a timer when the instant t1 is present, and to count the time between appearance of the instant t1 and the instant t3. The counted time is then correlated with tabulated or calculated data correlating the counted time with a slip between the load and the wash basin. The calculated slip can then be correlated to a water-fill extent, which is compared with a predefined or desired water-fill.

Figure 4:
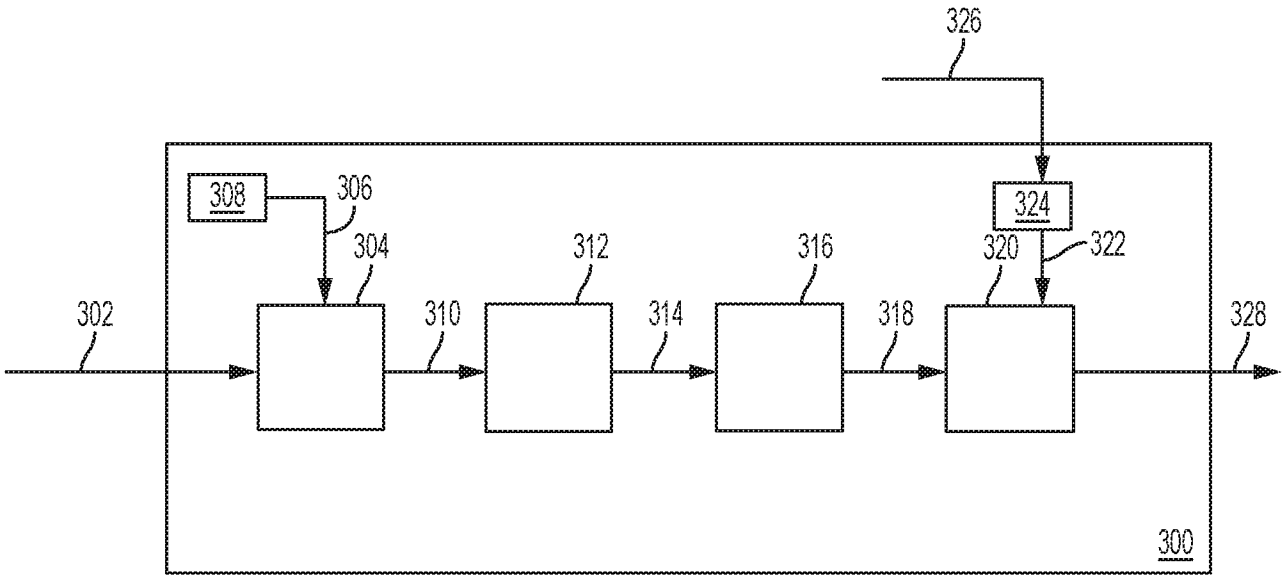
FIG. 4 is a schematic representation of a controller in accordance with the disclosure.

A schematic representation of a controller 300 in accordance with the disclosure is shown in FIG. 4. The controller 300 may be a single controller or may include more than one controller disposed to control various functions and/or features of a machine. For example, a master controller, used to control the overall operation and function of the machine, may be cooperatively implemented with a motor controller, used to control the motor 106. In this embodiment, the term "controller" is meant to include one, two, or more controllers that may be associated with the machine 100 and that may cooperate in controlling various functions and operations of the machine 100 (FIG. 1). The functionality of the controller, while shown conceptually in FIG. 4 to include various discrete functions for illustrative purposes only, may be implemented in hardware and/or software without regard to the discrete functionality shown. Accordingly, various interfaces of the controller are described relative to components of the wash system shown in the block diagram of FIG. 4. Such interfaces are not intended to limit the type and number of components that are connected, nor the number of controllers that are described.

In the illustrated embodiment, the controller 300 is configured to receive an input 302 that is indicative of a torque applied by the drive motor 106 operating to rotate the wash basin 104. As shown, the input 302 may be a waveform of current drawn by the motor. Additional parameters such as a commanded or actual speed of rotation of the motor, transmission and/or the wash basin may also be used. The input 302 is provided to a first function 304, which monitors and analyzes the input 302 based on a clock time 306 provided by an internal clock 308. The first function 304, which conceptually creates a time trace similar to the curve 206 shown in FIG. 2, monitors the input 302 to discern the time instants t1 and t3. As described above, the instant t1 represents a time at which a rotation of the wash basin reverses direction and the instant t3 represents a time at which a rotation of the load reverses direction. When the time instant t1 is determined to be present, a flag or trigger 310 is provided to a timer function 312, which begins to count a time period. An additional flag or trigger 310 is provided to the timer function when the time instant t3 is determined to be present. When the additional flag is received, the timer 312 stops counting the time period and provides the time period 314 to a lookup function 316.

The lookup function 316 utilizes a lookup table or other calculation function to correlate the time period 314 to a slip value 318. The slip value 318 may be determined empirically and is indicative of a degree of friction, slip or physical interference between the load and the wash basin or other agitator structures that interact with the load. The slip value 318 may be corrected in the function 316 using various machine or load parameters such as the particular agitator configuration used in the machine, the type of fabric present in the wash basin and the like. The slip value 318 is provided to a water-fill determination function 320, which may also receive a user setting 322 from a user selection function 324 that receives a user command or selection 326. For example, user selections can include the desired water amount, type of cycle, desired water temperature and fill-amount, and the like.

The water-fill determination function 320 generates a predefined or desired water fill amount, correlates the slip value 318 to an actual water-fill amount, and compares the actual water-fill with the desired water-fill to determine whether sufficient water has been added to the wash basin. When additional water is required, the water-fill determination function 320 provides a command 328 that causes a water fill valve, for example, the control valve 120 shown in FIG. 1, to add an incremental amount of water into the wash basin 104. In the event it is determined that excess water is present in the wash basin, the command 328 may cause the machine to drain water through the drain line 122. As can be appreciated, the controller 300 may be modified in an alternative embodiment such that the determination of a water-fill amount is made directly and the slip calculation is omitted or replaced.

Figure 5:
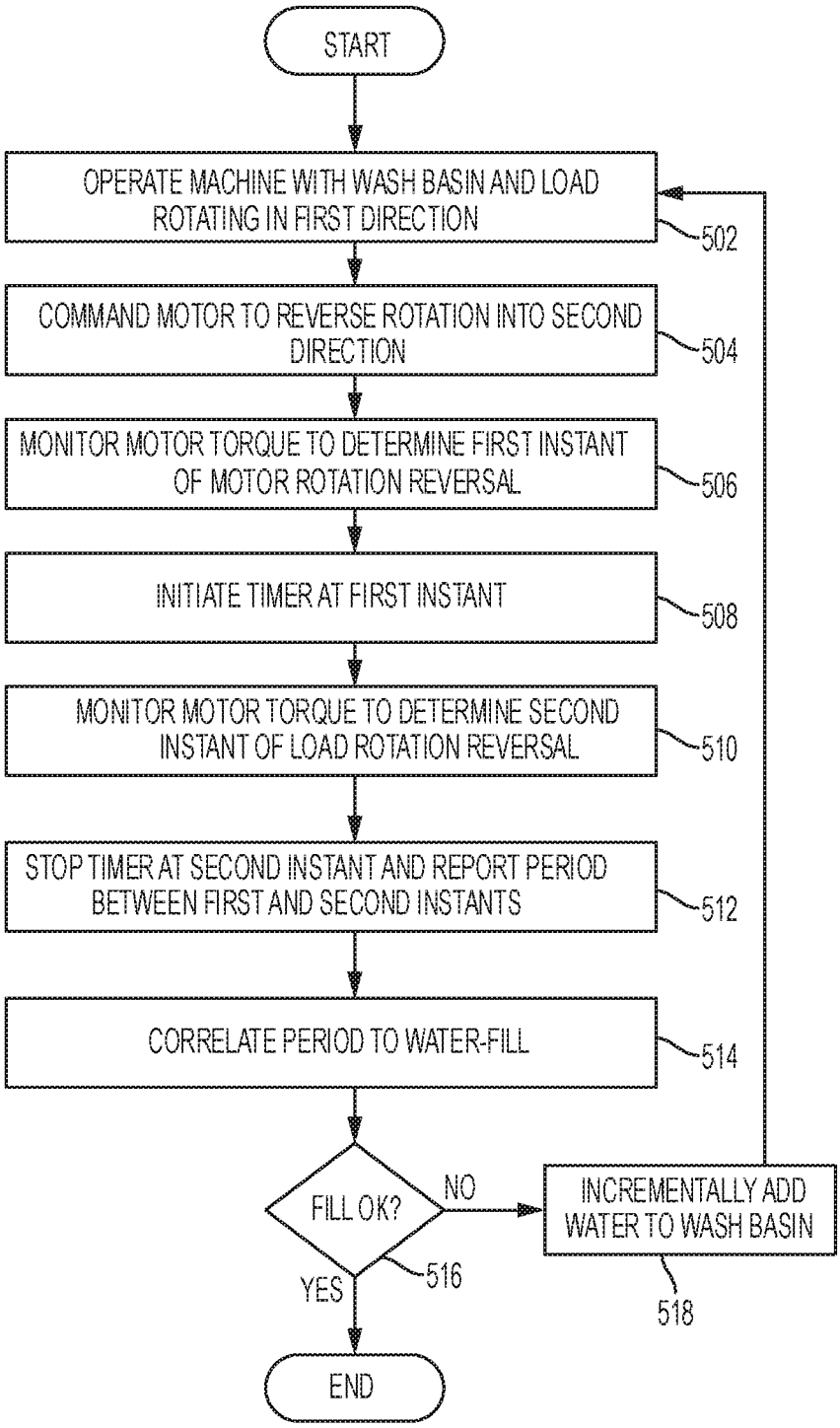
FIG. 5 is a flowchart for a method in accordance with the disclosure.

A flowchart for a method of adaptively filling a wash basin containing a load to a desired water-fill amount is shown in FIG. 5. In accordance with the method, a machine may operate such that a wash basin and a load present in the wash basin are rotating in a first direction at 502. To initiate a water-fill sufficiency determination, or as part of a wash cycle, the method includes commanding a motor reversal such that the motor reverses direction of rotation from the first direction to a second direction at 504. The command may include reversing a direction of torque application by the motor onto the wash basin that contains the load. The method further includes monitoring motor torque to determine a first peak at a first instant in time following the command to reverse rotation at 506. The first peak, at the first instant, is indicative of an actual reversal in the direction of rotation of the motor and is used to initiate a timer at 508, which counts an incrementally increasing time period.

The method further includes continuing to monitor motor torque to determine a second peak at 510, which occurs at a second instant in time following motor reversal and the first instant. The second instant is indicative of an actual reversal in the direction of rotation of the load in the wash basin and is used to stop the timer or terminate the time period measurement at 512 to determine a time period that elapsed between the first and second instants, or, the time period during which the wash basin and the load rotated in different directions, i.e., the motor in the second direction and the load still in the first direction. The time period between the first and second instants is correlated to a water-fill parameter at 514. In one embodiment, for example, the time period is correlated to a slip or physical interference between the wash basin, and any agitator structures associated with the wash basin, and the load. For example, the time period may be lower than desired when a load is not sufficiently suspended in water, which indicates an insufficient water fill, or may be higher than desired when excess water is suspending the load.

In accordance with the method, the correlation of the time period to a water-fill parameter leads to comparison with a predefined or desired water-fill parameter at 516. When the water-fill as indicated by the comparison is close to a desired level, the process ends. When the actual water-fill parameter as indicated, for example, by the time period, is below a desired level, water is incrementally added to the wash basin at 518 and the process repeats starting at 502, which in turn requires an additional reversal of rotation from the second direction back to the first direction at 504, and so forth.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A machine for washing fabric articles, the machine comprising:

a chassis;

a wash basin rotatably mounted in the chassis, the wash basin being adapted to accommodate therein a load, the load comprising one or more fabric items suspended in water;

a water inlet valve adapted to allow water from a supply to be added to the load;

a motor associated with the chassis and operably connected with the wash basin, the motor drawing a current during operation to generate a torque tending to rotate the wash basin in either direction of a first direction and a second direction; and an electronic controller associated with the motor, the electronic controller being programmed and operating to carry out a method comprising:

commanding the motor to rotate in the second direction while the wash basin and the load are rotating in the first direction;

monitoring the current drawn by the motor to determine a presence of a first current peak in the current drawn by the motor after commanding the motor to rotate in the second direction;

initiating a timer period when the first current peak is determined to be present;

monitoring the current drawn by the motor to determine presence of a second peak in the current drawn by the motor after determining presence of the first peak;

terminating the timer period when the second peak is determined to be present, resulting in the timer period having an elapsed time period between the first current peak and the second current peak;

providing a correlation between a value of the elapsed time period and a corresponding wash-fill level;

establishing, by applying the elapsed time period to the correlation, a present wash-fill level;

comparing the present wash-fill level to a desired wash-fill level; and operating, in accordance with the comparing, the water inlet valve to add water to the wash basin when the present wash-fill level is below the desired wash-fill level.

2. The machine of claim 1, further comprising a transmission disposed between the motor and the wash basin, wherein commanding the motor to rotate in the second direction includes commanding a shift in the transmission.

3. The machine of claim 1, wherein monitoring the current drawn by the motor includes processing a time-sequence of instantaneous values of the current drawn by the motor to identify a first torque peak at a first time instance.

4. The machine of claim 3, wherein monitoring the current draw by the motor includes processing the time-sequence of instantaneous values of the current drawn by the motor to identify a torque local minimum at an intermediate time instance and identify a second torque peak at a second time instance after the intermediate time instance.

5. The machine of claim 4, wherein the elapsed period is an elapsed time between the first time instance and the second time instance.

6. The machine of claim 1, wherein the elapsed time period is correlated to an amount of slip between the load and the wash basin; and thus the correlation represents a correlation between the elapsed time period and the amount of slip between the load and the wash basin.

7. The machine of claim 1, wherein the desired ash-fill level is determined based on an input from a user of the machine.

8. The machine of claim 1, wherein the desired wash-fill level is determined automatically.

* * * * *